US009321607B2

(12) United States Patent
Chen et al.

(10) Patent No.: US 9,321,607 B2
(45) Date of Patent: Apr. 26, 2016

(54) HAND-HELD TAPE DISPENSER

(71) Applicant: Chun-Yen Chen, Chang Hua (TW)

(72) Inventors: Chien-Hung Chen, Chang Hua (TW); Lai-Pin Lin, Chang Hua (TW)

(73) Assignee: Chun-Yen Chen (TW)

( * ) Notice: Subject to any disclaimer, the term of this patent is extended or adjusted under 35 U.S.C. 154(b) by 0 days.

(21) Appl. No.: 14/599,682

(22) Filed: Jan. 19, 2015

(65) Prior Publication Data

US 2015/0210501 A1 Jul. 30, 2015

(30) Foreign Application Priority Data

Jan. 24, 2014 (TW) ..... 103201573 U

(51) Int. Cl.

| | |
|---|---|
| ***B44C 7/00*** | (2006.01) |
| ***B29C 65/00*** | (2006.01) |
| ***B30B 15/34*** | (2006.01) |
| ***B65H 35/00*** | (2006.01) |
| ***B65H 37/00*** | (2006.01) |

(52) U.S. Cl.

CPC ..... *B65H 35/008* (2013.01); *B65H 35/0013* (2013.01); *B65H 35/0033* (2013.01); *B65H 37/005* (2013.01); *B65H 2601/521* (2013.01); *Y10T 156/1348* (2015.01); *Y10T 156/1788* (2015.01); *Y10T 156/1795* (2015.01)

(58) Field of Classification Search

CPC ..... B65H 35/002; B65H 35/008; B65H 35/0026; B65H 35/0013; B65H 35/0033; B65H 37/005; Y10T 156/1365; Y10T 156/1348; Y10T 156/1795; Y10T 156/1788

See application file for complete search history.

(56) References Cited

U.S. PATENT DOCUMENTS

| | | | | | |
|---|---|---|---|---|---|
| 2,726,783 | A * | 12/1955 | Erickson | B65B 7/2864 | 156/486 |
| 2,798,552 | A * | 7/1957 | Aldrich | B65H 35/0026 | 225/19 |
| 3,149,764 | A * | 9/1964 | Waltz | B65H 35/0026 | 225/57 |
| 3,325,336 | A * | 6/1967 | Gibson | B65H 37/00 | 156/577 |
| 4,889,581 | A * | 12/1989 | Ulrich | B65B 51/067 | 156/443 |
| 5,228,943 | A * | 7/1993 | Vasilakes | B65B 51/067 | 156/355 |
| 2006/0201984 | A1* | 9/2006 | Namekawa | B65H 35/0033 | 225/6 |
| 2009/0084504 | A1* | 4/2009 | Lam | B65B 51/067 | 156/538 |
| 2010/0175836 | A1* | 7/2010 | Lam | B65H 35/0013 | 156/468 |

* cited by examiner

*Primary Examiner* — Alex Efta
(74) *Attorney, Agent, or Firm* — Trop Pruner & Hu, P.C.

(57) ABSTRACT

A hand-held tape dispenser adapted for supporting a tape roll thereon and including a housing, a cutting unit connected to the housing, a protect cover, a noise reduction unit, and a linkage unit. The housing has an installing portion adapted to support the tape roll thereon. The protect cover is pivoted to the housing and has a grip portion corresponding in position to the installing portion. The noise reduction unit is pivoted to the housing and has a noise reduction roller that is adapted to contact a tape of the tape roll. The linkage unit interconnects the protect cover and the noise reduction unit such that the noise reduction unit and the protect cover are simultaneously pivotable toward or away from the installing portion.

10 Claims, 6 Drawing Sheets

HAND-HELD TAPE DISPENSER

CROSS REFERENCE TO RELATED APPLICATION

This application claims priority of Taiwanese Patent Application No. 103201573, filed on Jan. 24, 2014.

FIELD OF THE INVENTION

The disclosure relates to a tape dispenser, more particularly to a hand-held tape dispenser.

BACKGROUND OF THE INVENTION

A conventional hand-held tape dispenser, such as those disclosed in Taiwanese Utility Model Patent Nos. M299730 and M271864, includes a main body, a protect cover, a roller and a blade. The main body has an installing portion that is adapted for supporting a tape roll (a tape on a roll) thereon and that has a hollow space for finger extension. The protect cover is connected to the main body and nearby the installing portion for hand grabbing. The roller rotatably extends from the main body for guiding application of the tape. The blade is mounted on the main body and adjacent to the roller for cutting the tape. The conventional hand-held tape dispenser has such disadvantages as noise and inconvenience of operation.

The noise occurs during operation of the conventional hand-held tape dispenser as the tape is stripped out from the tape roll due to vibration in the relatively long stripped portion of the tape between the roller and the tape roll. Furthermore, when the diameter of the tape roll gradually reduces as the tape keeps being stripped out, the length of the tape between the roller and the tape roll becomes longer, creating bigger noises.

The inconvenience of operation occurs in a situation where, when a user grabs too hard on the protect cover and the hollow space at the installing portion during the operation, the protect cover may be pressed against the tape roll with a friction between the two hindering the operation of the conventional hand-held tape dispenser, or even injuring the user's wrist after long-term use.

SUMMARY OF THE INVENTION

Therefore, the object of the present invention is to provide a hand-held tape dispenser that can reduce the noise during tape application and that can avoid friction between a protect cover and a tape roll.

Accordingly, a hand-held tape dispenser is adapted for supporting a tape roll thereon. The hand-held tape dispenser includes a housing, a cutting unit, a protect cover, a noise reduction unit and a linkage unit. The housing has an installing portion that extends in an axial direction and that is adapted to support the tape roll thereon. The cutting unit includes a roller that is connected to the housing and that extends rotatably in the axial direction parallel to the installing portion, and a blade that is adjacent to the roller. The protect cover has a pivot portion that is pivoted to the housing about an axis extending in the axial direction, a grip portion that is connected to an end of the pivot portion and that corresponds in position to the installing portion, and a link portion that is connected to an opposite end of the pivot portion. The noise reduction unit is disposed in the housing and includes a press member and a noise reduction roller. The press member has a pivot end that is pivoted to the housing about an axis extending in the axial direction, and a roller end that is opposite to the pivot end. The noise reduction roller is connected rotatably to the roller end of the press member, and is adapted to contact a tape of the tape roll at a position adjacent to a stripped-unstripped-junction of the tape. The linkage unit includes a first member that is mounted on the link portion of the protect cover, and a second member that is mounted on the press member of the noise reduction unit and that is connected to the first member such that the noise reduction unit and the protect cover are simultaneously pivotable toward or away from the installing portion of the housing.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE EMBODIMENT

Figure 1:
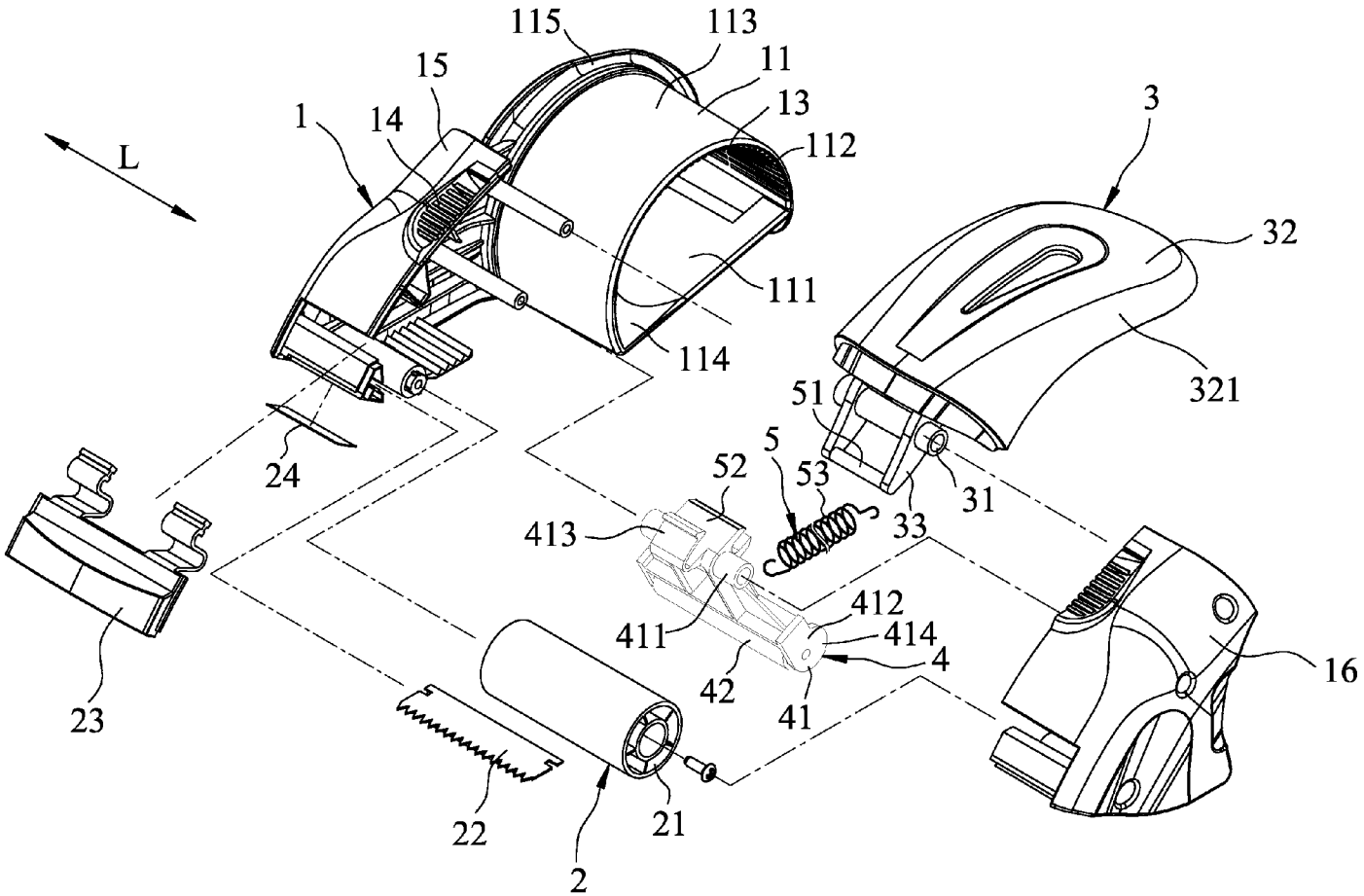
FIG. 1 is an exploded perspective view illustrating an embodiment of a hand-held tape dispenser according to the present invention.
Figure 2:
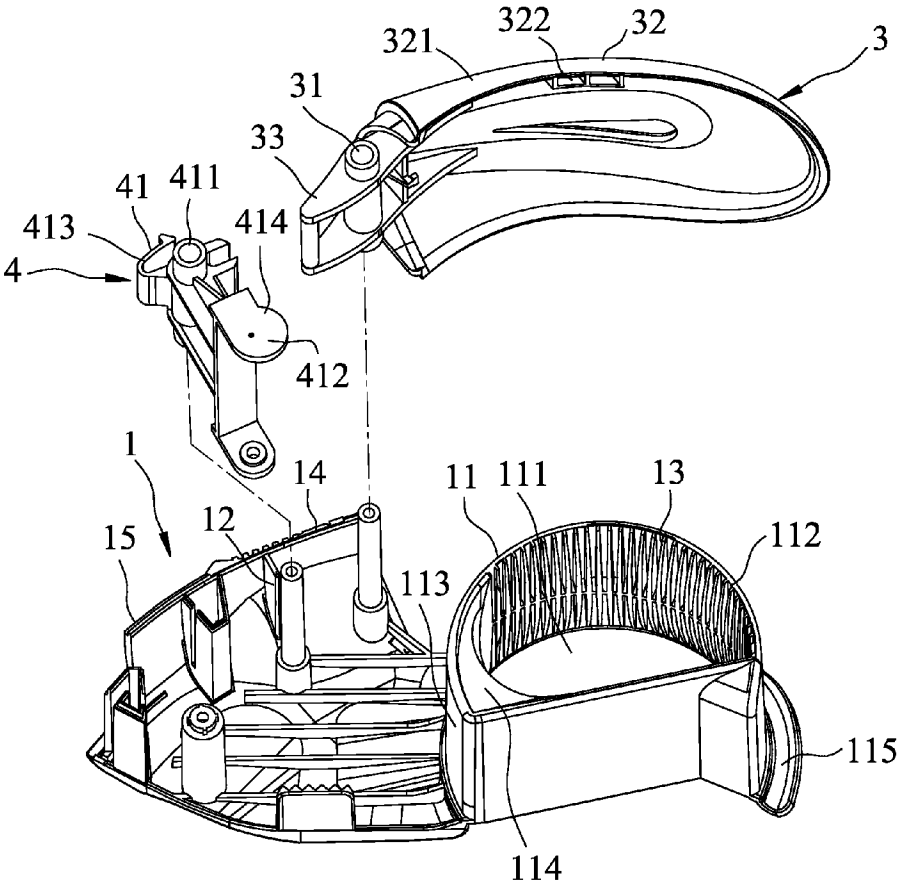
FIG. 2 is a partly exploded perspective view of a main body, a protect cover and a press member of the embodiment.

Referring to FIGS. 1 and 2, a preferred embodiment of a hand-held tape dispenser according to the present invention is illustrated. The hand-held tape dispenser is adapted for supporting a tape roll 10 (a tape on a roll) (see FIG. 3) thereon and includes a housing 1, a cutting unit 2, a protect cover 3, a noise reduction unit 4 and a linkage unit 5.

The housing 1 includes a main body 15 and aside body 16 coupled to the main body 15. The housing 1 has an installing portion 11 formed on the main body 15, extending in an axial direction (L) and adapted to support the tape roll 10 thereon, such that the tape roll 10 can rotate on the installing portion 11 about an axis extending in the axial direction (L). The installing portion 11 is hollow, and has an outer surface 113 adapted to contact the roll of the tape roll 10, an inner face 112 opposite to the outer face 113 and defining a space 111 for extension of a user's fingers, a reinforcing member 114 disposed in the space 111 and formed on the inner face 112, and a stop flange 115 protruding outwardly from the outer face 113. The reinforcing member 114 is disposed for enhancing the structural strength of the installing portion 11. The housing 1 further has a first anti-slip portion 14 and a second anti-slip portion 13. In this embodiment, the first anti-slip portion 14 is formed on the main body 15 and the side body 16. The second anti-slip portion 13 protrudes from the inner face 112 into the space 111, and has a thickness decreasing from a center thereof toward opposite lateral ends thereof in the axial direction (L). The housing 1 further has a block portion 12 that is formed in an inner space of the housing 1.

Figure 3:
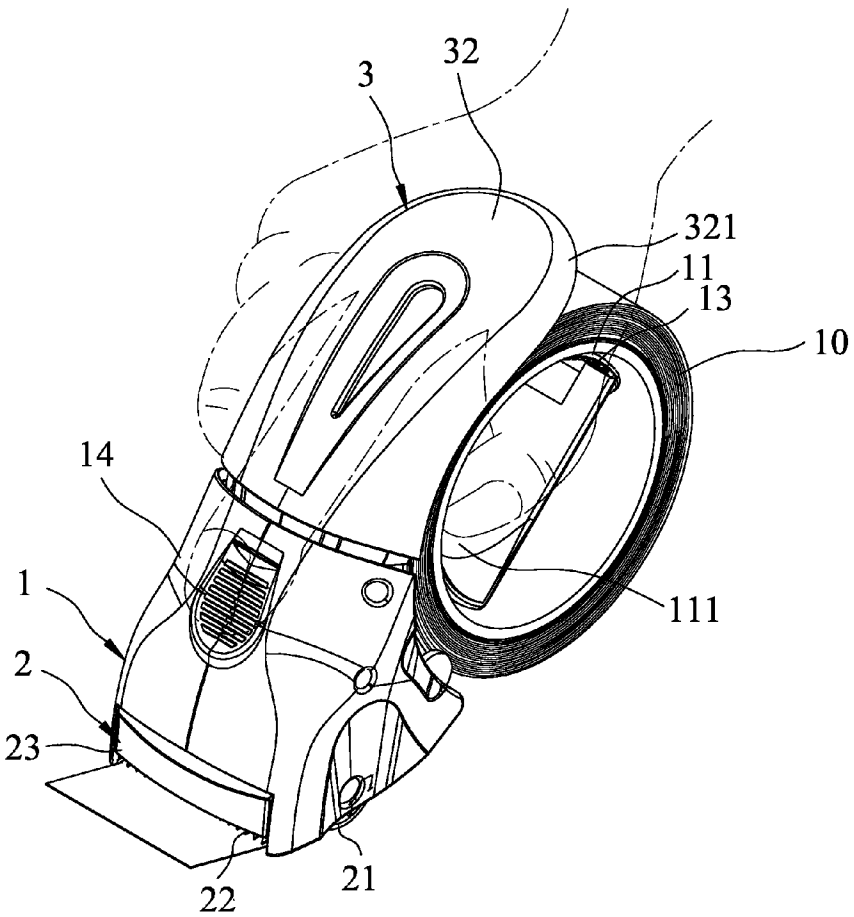
FIG. 3 is a perspective view illustrating the embodiment held by a user.
Figure 4:
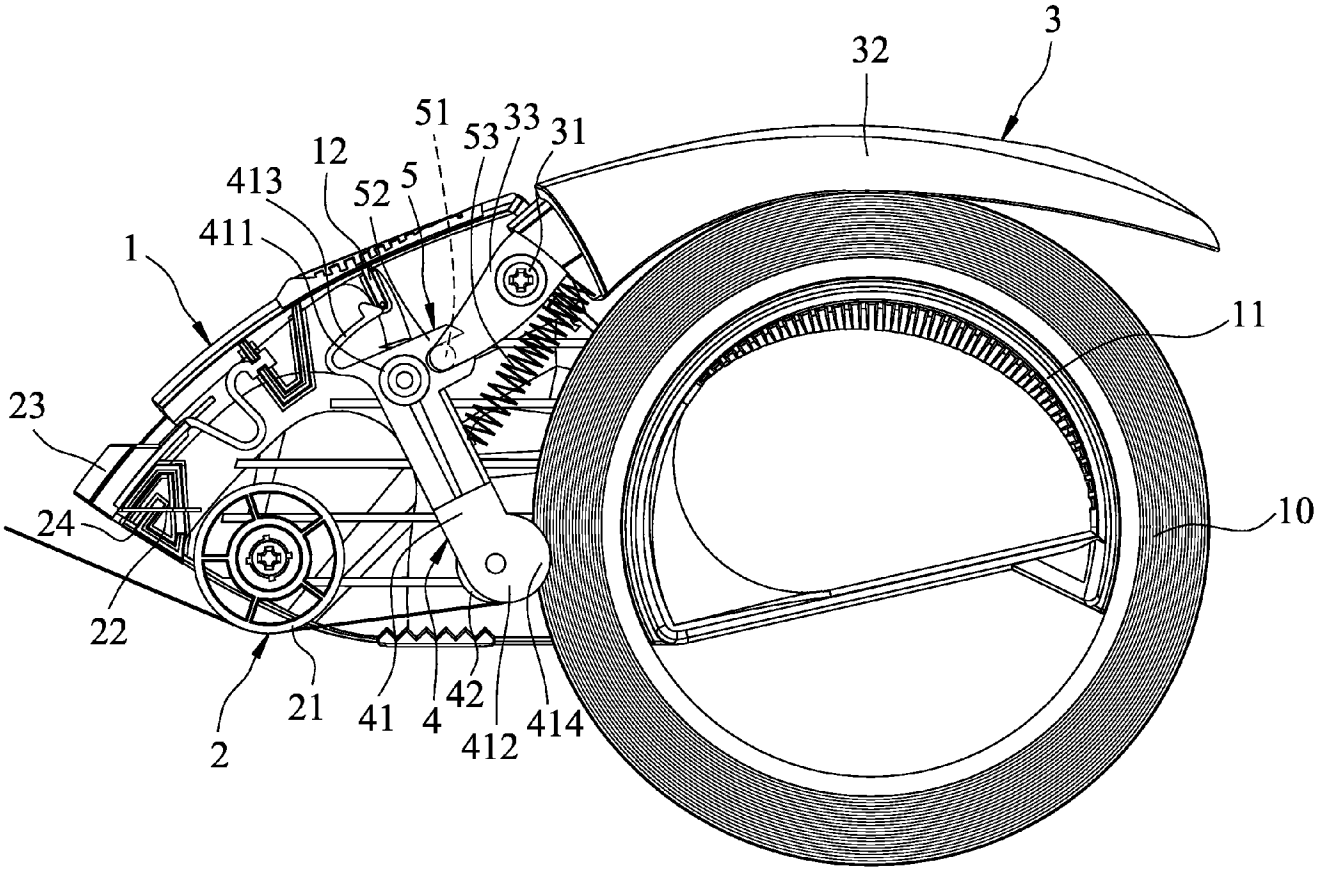
FIG. 4 is a partly sectional view of the preferred embodiment installed with a tape roll.

Referring further to FIGS. 3 and 4, the cutting unit 2 includes a roller 21 that is connected to the housing 1 and that extends rotatably in the axial direction (L) parallel to the installing portion 11, a blade 22 that is adjacent to the roller 21, a resilient cover member 23 that is mounted on the housing 1 and that is resiliently movable to cover or uncover the blade 22, and an attractor 24 disposed on the housing 1 between the roller 21 and the blade 22. The attractor 24 is adapted to attract a stripped segment of the tape via triboelectric effect and prevent rollback of the tape roll 10.

The protect cover 3 is disposed close to the first anti-slip portion 14, and has a pivot portion 31 that is pivoted to the housing 1 about an axis extending in the axial direction (L), a grip portion 32 that is connected to an end of the pivot portion 31 and that corresponds in position to the installing portion 11, and a link portion 33 that is connected to an opposite end of the pivot portion 31. The grip portion 32 of the protect cover 3 has a peripheral edge section 321 extending substantially toward the installing portion 11, and a block 322 disposed between the peripheral edge section 321 and the installing portion 11 for preventing fallout of the tape roll 10 from the installing portion 11. Furthermore, the grip portion 32 and the peripheral edge section 321 cooperatively form an ergonomic shape for comfortable wielding. Also, the first and second anti-slip portions 14, 13 of the housing 1, and the grip portion 32 of the protect cover 3 are formed in symmetric shapes, and therefore the user can wield the hand-held tape dispenser by either the left hand or the right hand with the forefinger pressing on the first anti-slip portion 14 and the other four fingers resting on the second anti-slip portion 13.

The noise reduction unit 4 is disposed in the housing 1 nearby the block portion 12 of the housing 1, and includes a press member 41 and a noise reduction roller 42. The press member 41 has a pivot end 411 pivoted to the housing 1 about an axis extending in the axial direction (L), a roller end 412 opposite to the pivot end 411, a hook portion 413 nearby the block portion 12, and a boundary portion 414 extending from the roller end 412 toward the installing portion 11 of the housing 1. The hook portion 413 is engageable with the block portion 12 for facilitating replacement of the tape roll 10. The boundary portion 414 is adapted for preventing fallout of the tape roll 10 from the installing portion 11. The noise reduction roller 42 is connected rotatably to the roller end 412 and is adapted to contact the tape roll 10 at a position adjacent to the stripped-unstripped-junction of the tape.

The linkage unit 5 includes a first member 51 that is mounted on the link portion 33 of the protect cover 3, and a second member 52 that is mounted on the press member 41 of the noise reduction unit 4 and that is connected to the first member 51. In this embodiment, the first member 51 and the second member 52 cooperatively form a revolute joint with the first member 51 as a rod and the second member 52 as a groove that is engaged with the rod, such that the noise reduction unit 4 and the protect cover 3 are simultaneously pivotable toward or away from the installing portion 11 of the housing 1, and that the grip portion 32 is spaced apart from the tape roll 10 during the entire tape application process.

The linkage unit 5 further includes a resilient member 53. In this embodiment, the resilient member 53 is a tension spring, which has opposite ends that are connected respectively to the protect cover 3 and the press member 41 for biasing the noise reduction roller 42 of the noise reduction unit 4 to contact the tape at the position adjacent to the stripped-unstripped-junction of the tape. It should be noted that, in other embodiments of the present invention, the resilient member 53 may be a compression spring that interconnects the housing 1 and the press member 41 or interconnects the housing 1 and the protect cover 3, while the first and second members 51, 52 may be configured as gears meshing with each other.

Figure 5:
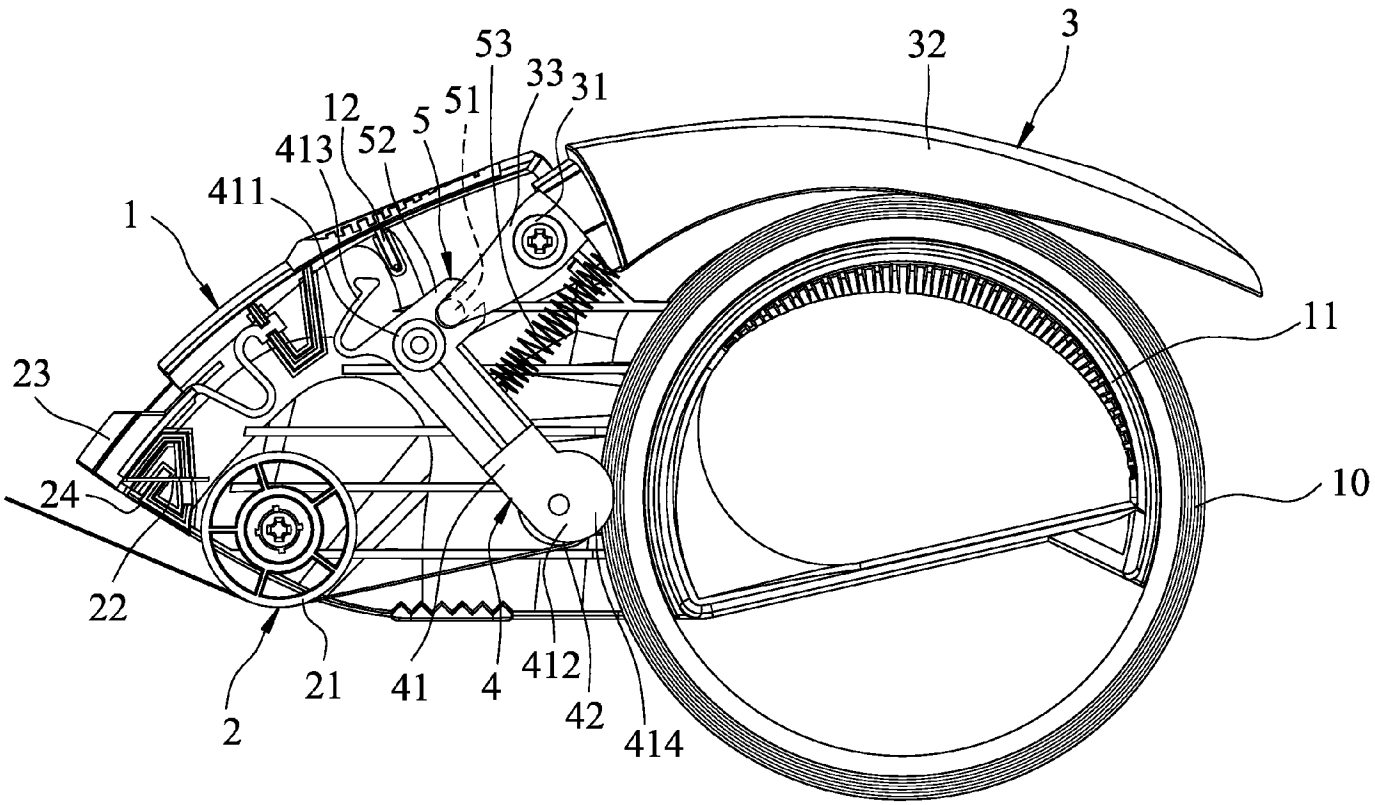
FIG. 5 is a partly sectional view illustrating the embodiment in use with less of the tape roll.

During the operation in this embodiment, as shown in FIG. 4, the tape roll 10 is secured on the installing portion 11 of the housing 1 by the stop flange 115 (see FIG. 1) of the installing portion 11, the block 322 (see FIG. 2) of the grip portion 32 of the protect cover 3, and the boundary portion 414 of the press member 41. The noise reduction roller 42 of the noise reduction unit 4 constantly contacts the tape roll 10 at the position adjacent to the stripped-unstripped-junction of the tape due to enforcement from the resilient member 53 of the linkage unit 5 and from the protect cover 3 which is pressed toward the tape roll 10 by the user's hand. As such, the noise reduction roller 42 manages stripping speed of the tape, thereby alleviating noise caused in the tape stripping process. Also due to constraint from the linkage unit 5, the protect cover 3 does not contact the tape roll 10 to cause friction, which would otherwise hinder the tape stripping process. Referring to FIG. 5, as the tape continues to be stripped out from the roll, diameter of the tape roll 10 shrinks; the noise reduction roller 42 can keep contacting the tape roll 10, and the protect cover 3 can approach but not contact the tape roll 10 due to mechanism of the linkage unit 5.

Figure 6:
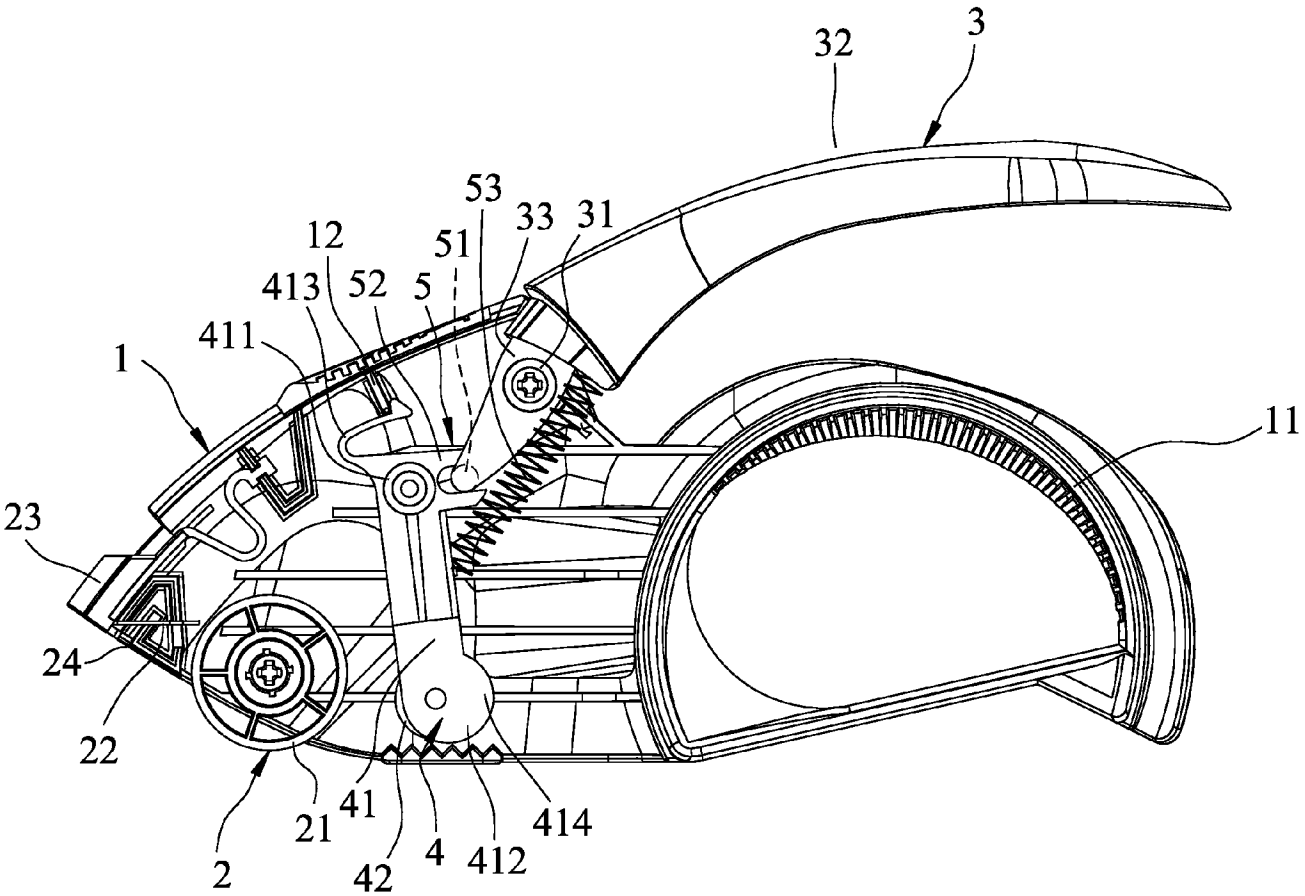
FIG. 6 is a partly sectional view of the embodiment, illustrating a hook portion of the press member and a block portion of a housing engaging each other.

Referring to FIG. 6, when the tape runs out, the user can swing the protect cover 3 away from the installing portion 11 to thereby drive pivot movement of the press member 41 until the hook portion 413 of the press member 41 engages the block portion 12 of the housing 1, thereby facilitating replacement of the tape roll 10 (see FIG. 3).

It should be noted that, the resilient member 53 only serves as the enforcement for the linkage unit 5, and the linkage unit 5 can be operated manually by the user as well to keep the noise reduction roller 42 of the noise reduction unit 4 in contact with the tape at the position adjacent to the stripped-unstripped-junction of the tape, with the resilient member 53 being omitted.

In a summary view of the description above, by virtue of the noise reduction roller 42 of the noise reduction unit 4 and the linkage unit 5 that connects the protect cover 3 and the noise reduction unit 4, the noise reduction roller 42 can constantly contact the tape roll 10 at the position adjacent to the stripped-unstripped-junction of the tape to keep down the noise caused during the tape application process, and the protect cover 3 is prevented from contacting the tape roll 10 due to the mechanism of the linkage unit 5. Therefore, the hand-held tape dispenser according to the present invention is able to improve upon the disadvantages of the conventional hand-held tape dispenser.

While the present invention has been described in connection with what is considered the most practical embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A hand-held tape dispenser adapted for supporting a tape roll thereon, said hand-held tape dispenser comprising:

a housing having an installing portion that extends in an axial direction and that is adapted to support the tape roll thereon;

a cutting unit disposed in front of said installing portion and including a roller that is connected to said housing and that extends rotatably in the axial direction parallel to said installing portion, and a blade that is disposed in front of said roller;

a protect cover having a pivot portion that is pivoted to said housing about an axis extending in the axial direction, a grip portion that is connected to an end of said pivot portion and that extends rearwardly from said pivot portion and above said installing portion to cover said installing portion, and a link portion that is connected to an opposite end of said pivot portion;

a noise reduction unit disposed in said housing between said installing portion and said roller of said cutting unit, and including a press member that has a pivot end pivoted to said housing about an axis that extends in the axial direction, and a roller end opposite to said pivot end, and a noise reduction roller that is connected rotatably to said roller end of said press member, and that is adapted to contact a tape of the tape roll at a position adjacent to a stripped-unstripped-junction of the tape; and a linkage unit including a first member that is mounted on said link portion of said protect cover, and a second member that is mounted on said press member of said noise reduction unit and that is connected to said first member such that said noise reduction unit and said protect cover are simultaneously pivotable toward or away from said installing portion of said housing.

2. The hand-held tape dispenser as claimed in claim 1, wherein said linkage unit further includes a resilient member having opposite ends that are connected respectively to said protect cover and said press member for biasing said noise reduction roller to contact the tape at the position adjacent to the stripped-unstripped-junction.

3. The hand-held tape dispenser as claimed in claim 1, wherein:

said housing further has a block portion disposed above said press member of said noise reduction unit; and said press member further has a hook portion engageable with said block portion for facilitating replacement of the tape roll.

4. The hand-held tape dispenser as claimed in claim 1, wherein said housing includes a main body having said installing portion, and a side body coupled to said main body, said housing further having a first anti-slip portion that is formed on at least one of said main body and said side body and that is adjacent to said protect cover for preventing finger slipping.

5. The hand-held tape dispenser as claimed in claim 4, wherein:

said installing portion of said housing has an outer face adapted to contact the tape roll, and an inner face opposite to said outer face and defining a space for extension of a user's fingers; and said housing further has a second anti-slip portion protruding from said inner face into said space.

6. The hand-held tape dispenser as claimed in claim 1, wherein said grip portion of said protect cover has:

a peripheral edge section extending substantially toward said installing portion; and a block disposed between said peripheral edge section and said installing portion for preventing fallout of the tape roll from said installing portion.

7. The hand-held tape dispenser as claimed in claim 1, wherein said first member and said second member of said linkage unit cooperatively form a revolute joint.

8. The hand-held tape dispenser as claimed in claim 1, wherein said cutting unit further includes a resilient cover member mounted on said housing and resiliently movable to cover or uncover said blade.

9. The hand-held tape dispenser as claimed in claim 8, wherein said cutting unit further includes an attractor disposed on said housing between said roller of said cutting unit and said blade, and adapted to attract a stripped segment of the tape of the tape roll and prevent rollback of the tape roll.

10. The hand-held tape dispenser as claimed in claim 1, wherein said press member of said noise reduction unit further has a boundary portion extending from said roller end toward said installing portion of said housing and adapted for preventing fallout of the tape roll from said installing portion.

* * * * *